US008727720B2

(12) United States Patent
Nagler et al.

(10) Patent No.: US 8,727,720 B2
(45) Date of Patent: May 20, 2014

(54) GUIDE VANE OF A GAS TURBINE AND METHOD FOR REPLACING A COVER PLATE OF A GUIDE VANE OF A GAS TURBINE

(75) Inventors: Christoph Nagler, Zürich (CH); Jose Anguisola McFeat, Lauchringen (DE); Sergei Riazantsev, Stetten (CH); Marcel Koenig, Wettingen (CH); Erich Kreiselmaier, Stetten (CH)

(73) Assignee: Alstom Technology Ltd, Baden (CH)

( * ) Notice: Subject to any disclaimer, the term of this patent is extended or adjusted under 35 U.S.C. 154(b) by 1167 days.

(21) Appl. No.: 12/827,696

(22) Filed: Jun. 30, 2010

(65) Prior Publication Data

US 2011/0014054 A1 Jan. 20, 2011

(30) Foreign Application Priority Data

Jul. 3, 2009 (EP) ..... 09164551

(51) Int. Cl.
*F01D 9/02* (2006.01)

(52) U.S. Cl.
USPC ..... 415/209.4

(58) Field of Classification Search
USPC ..... 415/170.1, 173.7, 191, 142, 209.3, 415/209.4; 29/889.1, 889.2, 889.22
See application file for complete search history.

(56) References Cited

U.S. PATENT DOCUMENTS

| | | | | |
|---|---|---|---|---|
| 5,022,818 | A * | 6/1991 | Scalzo | 415/209.3 |
| 6,773,229 | B1 * | 8/2004 | Itzel et al. | 415/191 |
| 2009/0304503 | A1 | 12/2009 | Bergander et al. | |
| 2010/0098537 | A1 | 4/2010 | Hamana | |

FOREIGN PATENT DOCUMENTS

| | | |
|---|---|---|
| EP | 0 384 166 A2 | 8/1990 |
| EP | 1 843 009 A1 | 10/2007 |
| WO | WO 2009/001415 | 12/2008 |

OTHER PUBLICATIONS

European Search Report for EP 09164551.5 dated Jan. 26, 2010.

* cited by examiner

*Primary Examiner* — Edward Look
*Assistant Examiner* — Juan G Flores
(74) *Attorney, Agent, or Firm* — Buchanan Ingersoll & Rooney PC

(57) ABSTRACT

The guide vane of a gas turbine comprises a blade having an outer platform connectable to a guide vane carrier or gas turbine casing, and at the opposite end an inner platform that carries a cover plate. The inner platform has a dovetail housing to which the cover plate is connected. The method for replacing the cover plate consists in separating the cover plate from the inner platform by cutting along the profile of the dovetail housing, then making the cover plate to slide out of the dovetail housing, thus inserting a new or refurbished cover plate into the dovetail housing.

8 Claims, 2 Drawing Sheets

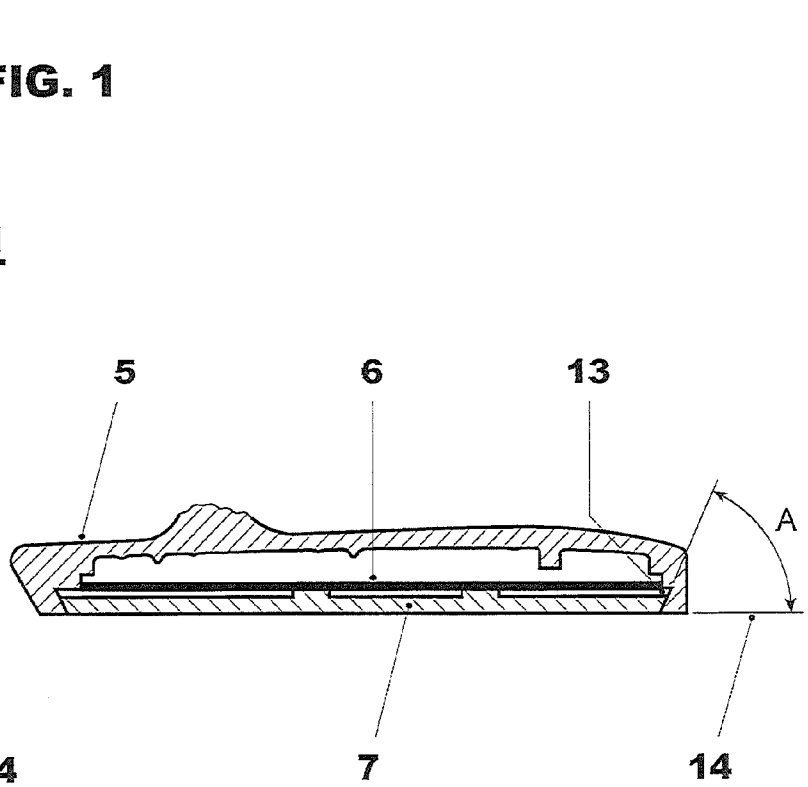
FIG. 2
FIG. 1
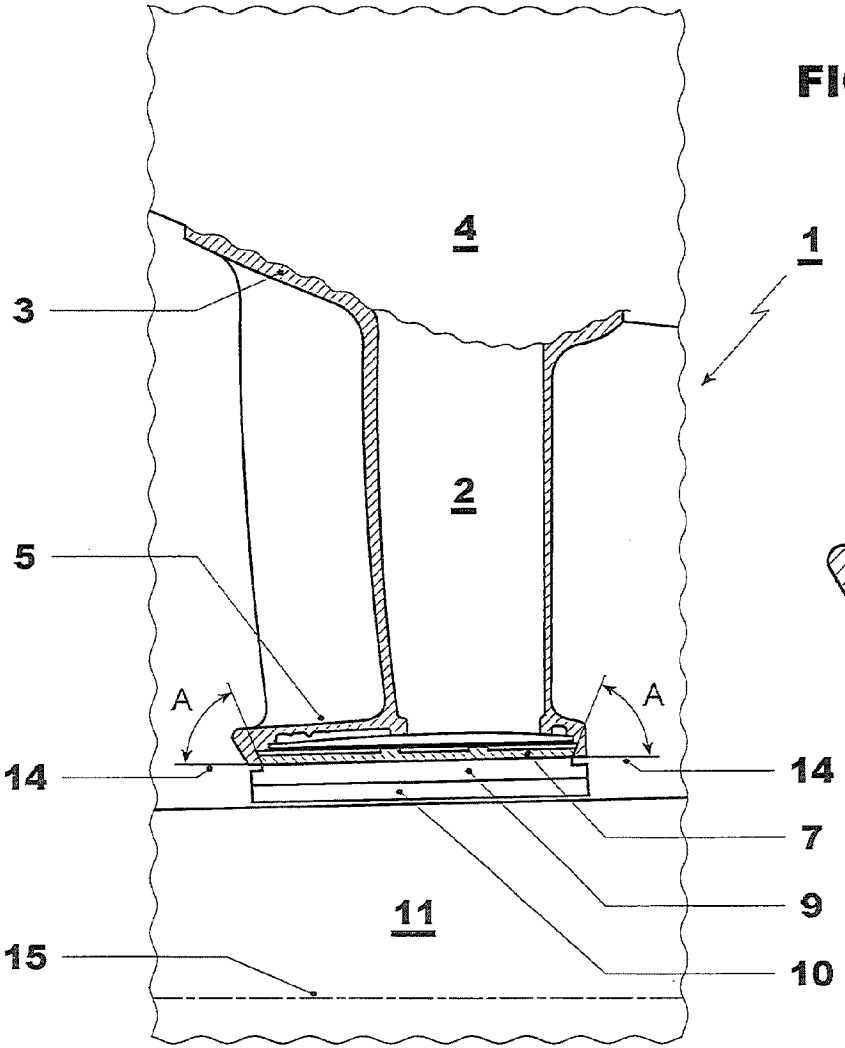

GUIDE VANE OF A GAS TURBINE AND METHOD FOR REPLACING A COVER PLATE OF A GUIDE VANE OF A GAS TURBINE

TECHNICAL FIELD

The present invention relates to a guide vane of a gas turbine and a method for replacing a cover plate of a guide vane of a gas turbine.

BACKGROUND OF THE INVENTION

Guide vanes are known to comprise blades that have one end with an outer platform connected to a guide vane carrier or gas turbine casing, and an opposite end provided with an inner platform facing the rotor.

Moreover, in order to withstand the high temperature of the hot gases flowing in the hot gases path, guide vanes (and in particular those closest to the combustion chamber) have an inner cooling circuit.

This inner cooling circuit comprises a path that makes a cooling fluid (typically compressed air) to circulate within the guide vanes and be ejected into the hot gases path through cooling holes provided over the guide vanes.

For manufacturing reasons (otherwise it would not be possible for example to realise the cooling circuit), the guide vanes have apertures at both the outer and inner platform; the inner platform is then closed by a cover plate.

Traditionally, the inner platform has a housing with L-shaped sides, such that the cover plate is inserted in the housing with the terminal portions of the L-shaped sides that withhold it; then the cover plate is also connected (usually brazed) to the platform.

Periodically the cover plates must be removed from the housing to be reconditioned; after the cover plates are removed, new or the same cover plates (after reconditioning) must be connected in the housing of the inner platform.

Nevertheless, removal of the cover plates is carried out by milling the L-shaped sides of the housing.

Thus, when the cover plates are re-inserted into the housing, they are only brazed thereto, but there is no mechanical withholding due to the L-shaped sides of the housing.

The brazing connection is not as reliable as the mechanical connection and in some cases could break.

SUMMARY OF THE INVENTION

The technical aim of the present invention is therefore to provide a guide vane of a gas turbine and method for replacing a cover plate of a guide vane of a gas turbine by which the said problems of the known art are eliminated.

Within the scope of this technical aim, an object of the invention is to provide a guide vane and a method with which the connection between the inner platform and the cover plate even after the reconditioning operations is very reliable.

Another object of the invention is to provide a method which enable the cover plate of an inner platform of a guide vane be replaced without substantially impairing the mechanical withholding of the cover plate into the housing.

The technical aim, together with these and further objects, are attained according to the invention by providing a guide vane of a gas turbine and method for replacing a cover plate of a guide vane of a gas turbine in accordance with the accompanying claims.

BRIEF DESCRIPTION OF THE DRAWINGS

Further characteristics and advantages of the invention will be more apparent from the description of a preferred but non-exclusive embodiment of the guide vane and method according to the invention, illustrated by way of non-limiting example in the accompanying drawings, in which:

FIG. 1 is a schematic partial cross section of a guide vane according to the invention;

FIG. 2 is an enlarged inner platform of FIG. 1;

DETAILED DESCRIPTION OF THE INVENTION

Figure 3:
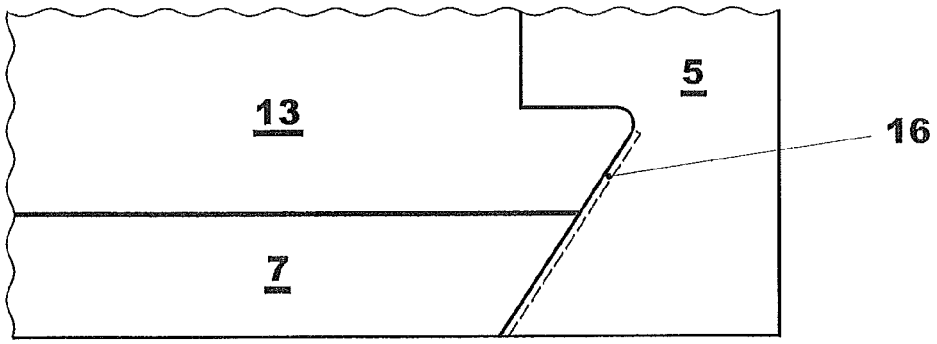
FIG. 3 is a further enlarged portion of FIG. 2.
Figure 4:
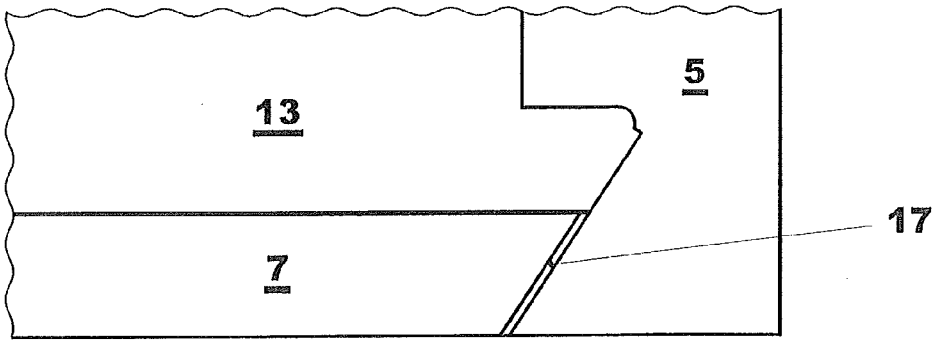
FIG. 4 shows a portion of a dovetail housing with a new or refurbished cover plate inserted thereinto.

With reference to the figures, these show a guide vane of a gas turbine generally indicated by the reference 1.

The guide vane 1 comprises a blade 2 having an outer platform 3 connected to a guide vane carrier or gas turbine casing 4.

At the opposite end, the guide vane 2 has an inner platform 5 that carries an impingement plate 6 and a cover plate 7.

The cover plate 7 is connected to a honeycomb 9 and a seal 10 that faces a rotor 11.

The inner platform 5 has a dovetail housing 13 to which the cover plate 7 is connected.

In particular the dovetail housing 13 has sides tilted by an angle A being 50-70° with respect to an axis 14 parallel to the gas turbine axis 15, preferably 56-64° and more preferably about 60°.

Moreover, preferably the guide vane of the invention is the first or second guide vane after a combustion chamber of the gas turbine.

The present invention also refers to a method for replacing a cover plate of a guide vane of a gas turbine.

In particular the method is implemented with a guide vane 1 having the structure above described with the inner platform 5 that has a dovetail housing 13 for holding the cover plate 7.

The method consists in separating the cover plate 7 from the inner platform 5 by cutting (typically by milling) along the profile of the dovetail housing 13.

In this respect, FIG. 3 schematically shows an end of the platform 5 defining the housing 13 with a portion of the cover plate 7.

FIG. 3 also shows a cut 16 made by milling (in particular FIG. 3 only shows one end of the platform, but the cut at the other end is substantially similar to that shown).

After a cut 16 at each end of the housing 13 is made (and thus the cover plate 7 is separated from the inner platform 5), the cover plate is made to slide out of the housing 13.

Afterwards a new or refurbished cover plate 7 (the same or a different refurbished cover plate 7) is inserted into the housing 13; also in this case, the new or refurbished cover plate is made to slide into the housing 13.

Typically, after the new or refurbished cover plate 7 has been inserted in the housing 13, it is brazed to the inner platform 5.

For example this could be achieved by providing a brazing material 17 between the cover plate 7 and the inner platform 5 (along the sides of the housing 13) and when the cover plate 7 is inside of the housing 13, by heating the guide vane 1 in an oven, such that the brazing material melts (naturally the melting temperature of the brazing material must be greater than the working temperatures of the guide vane).

The cut 16 is made in the platform 5 (as shown in FIG. 3) even if in further embodiments it may also be cut partly in the cover plate 7 and partly in the platform 5.

The guide vane and the method conceived in this manner are susceptible to numerous modifications and variants, all falling within the scope of the inventive concept; moreover all details can be replaced by technically equivalent elements.

In practice the materials used and the dimensions can be chosen at will according to requirements and to the state of the art.

REFERENCE NUMBERS

1 guide vane
2 blade
3 outer platform
4 guide vane carrier or gas turbine casing
5 inner platform
6 impingement plate
7 cover plate
9 honeycomb
10 seal
11 rotor
13 dovetail housing
14 axis
15 gas turbine axis
16 cut
17 brazing material
A angle of the dovetail housing sides

The invention claimed is:

1. Guide vane of a gas turbine comprising a blade having an outer platform connectable to a guide vane carrier or gas turbine casing, and at the opposite end an inner platform that carries an impingement plate and a cover plate, wherein the inner platform has a dovetail housing to which said cover plate is connected.

2. Guide vane as claimed in claim 1, wherein said dovetail housing has sides tilted by 50-70° with respect to an axis parallel to the gas turbine axis.

3. Guide vane as claimed in claim 1, comprising being the first or second guide vane after a combustion chamber of the gas turbine.

4. Guide vane as claimed in claim 1, wherein said dovetail housing has sides tilted by 56 to 64° with respect to an axis parallel to the gas turbine axis.

5. Guide vane as claimed in claim 1, wherein said dovetail housing has sides tilted by 60° with respect to an axis parallel to the gas turbine axis.

6. Method for replacing a cover plate of a guide vane of a gas turbine comprising a blade having an outer platform connectable to a guide vane carrier or gas turbine casing and at the opposite end an inner platform that carries a cover plate, wherein the inner platform has a dovetail housing to which said cover plate is connected, wherein separating the cover plate from the inner platform by cutting along the profile of the dovetail housing, then making the cover plate to slide out of the dovetail housing, thus inserting a new or refurbished cover plate into the dovetail housing.

7. Method as claimed in claim 6, wherein after the new or refurbished cover plate has been inserted in the housing, it is brazed to the inner platform.

8. Method as claimed in claim 6, wherein cutting is carried out at least partially in the inner platform.

* * * * *